US005520281A

United States Patent [19]

Huang

[11] Patent Number: 5,520,281

[45] Date of Patent: May 28, 1996

[54] PRODUCT CARD OF HOOKS

[76] Inventor: Chun-Yen Huang, No. 53-6, Fu Chen St, Chang Hua City, Taiwan

[21] Appl. No.: 436,532

[22] Filed: May 8, 1995

[51] Int. Cl.[6] ..... A44B 7/00

[52] U.S. Cl. ..... 206/348; 206/338; 206/820; 206/343; 428/43

[58] Field of Search ..... 206/343, 344, 206/345, 348, 360, 820; 428/43

[56] References Cited

U.S. PATENT DOCUMENTS

| | | | |
|---|---|---|---|
| 712,422 | 10/1902 | Stokes | 206/820 |
| 1,958,829 | 5/1934 | Lewin, Jr. | 428/43 |
| 2,188,310 | 1/1940 | Price | 428/43 |
| 3,438,486 | 4/1969 | Pinkas | 206/820 |
| 4,279,341 | 7/1981 | Pleickhardt | 206/820 |
| 4,341,303 | 7/1982 | Britt | 206/343 |
| 4,999,230 | 3/1991 | Pipkins | 206/820 |

*Primary Examiner*—David T. Fidei
*Attorney, Agent, or Firm*—Bacon & Thomas

[57] ABSTRACT

A product card of hooks comprising a sheet of paper card base having both sides covered with a respective strippable cover film, the sheet of paper card base being punched into a plurality of disposable hooks in it, the disposable hooks having tiny connecting portions maintained linked to the sheet of paper card base, each disposable hook comprising an elongated body having two opposite ends turned inwards and formed into an open hook portion and a close hook portion respectively.

6 Claims, 9 Drawing Sheets

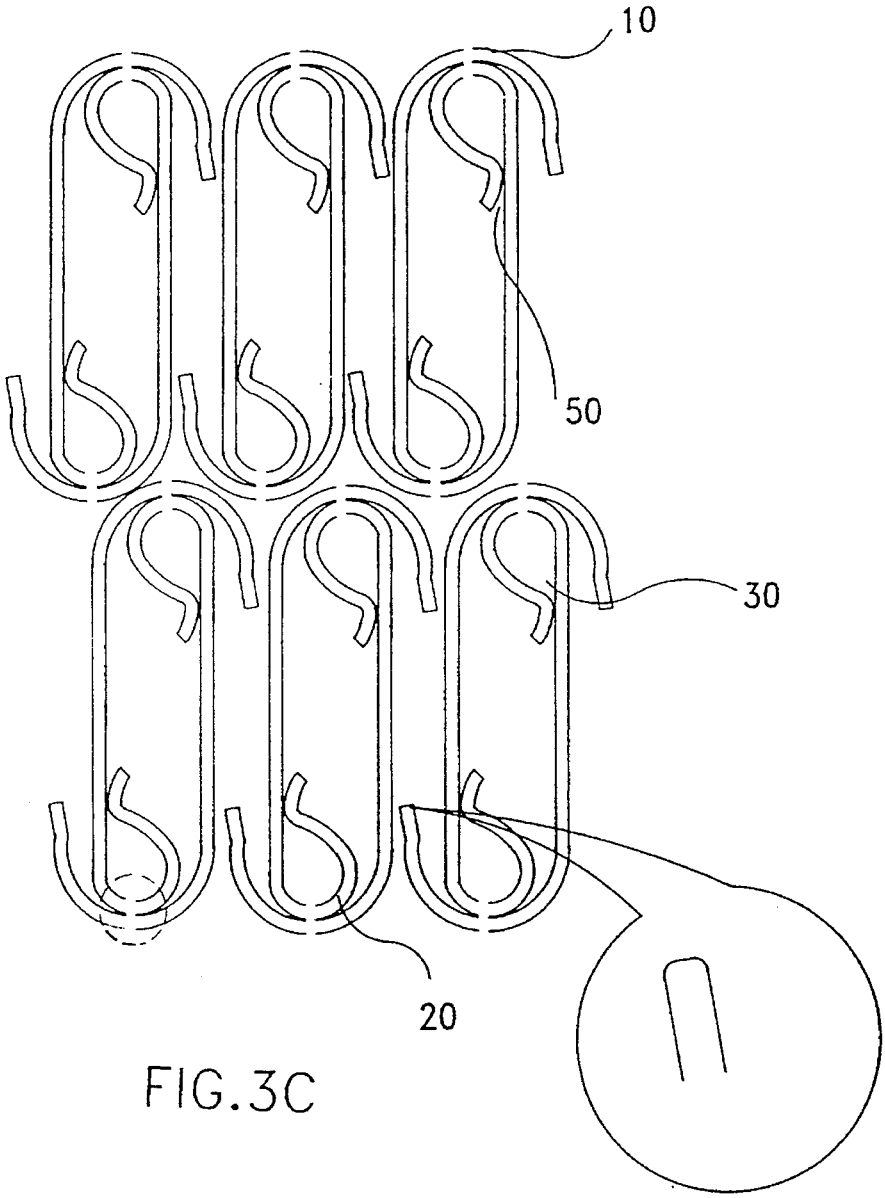
FIG.3C
FIG.3D
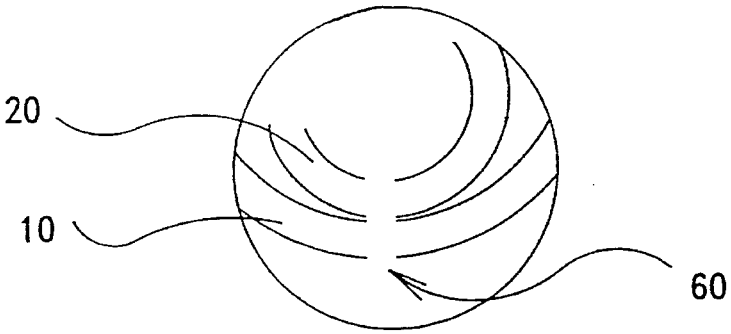
FIG.3E

PRODUCT CARD OF HOOKS

BACKGROUND OF THE INVENTION

The present invention relates to a product card which has hooks detachably formed in it.

Regular disposable hooks for hanging labels, Christmas tree ornaments, etc., are commonly made from metal wires and packed in blister cards for sale. FIG. 1 shows a disposable hook of this type. As illustrated, the hook has two opposite ends bent inwards and formed into an open hook portion 10' and a close hook portion 20'. The close hook portion 20' terminates in a guide tip 40'. When in use, the guide tip 40'must be lifted from the body of the disposable hook itself to open the loop 30' defined by the close hook portion 20', so that the close hook portion 20' can be fastened to a support for hanging a label or an ornament on the open hook portion 10'. Because the disposable hook is made from a metal wire, the user's fingers may be injured by the guide tip 40' when lifting the guide tip 40' from the body of the disposable hook itself for hanging a label or an ornament on the close hook portion 20'. Because these disposable hooks are commonly packed in the blister 60' of a blister card 50' for sable, their packing cost is high. Furthermore, the blister card needs much storage space.

SUMMARY OF THE INVENTION

The present invention has been accomplished under the circumstances in view. It is one object of the present invention to provide disposable hooks which are made from paper and used for temporary light duty such as to hang decorative articles on a Christmas tree. It is another object of the present invention to provide disposable hooks which are arranged in pairs in a sheet of product card. According to the present invention, a product card is provided comprised of a sheet of paper card base having both sides covered with a respective strippable cover film. The sheet of paper card base is punched into a plurality of disposable hooks in it. The disposable hooks are arranged in pairs, having tiny connecting portions maintained linked to the sheet of paper card base. Each disposable hook comprises an elongated body having two opposite ends turned inwards and formed into an open hook portion for hanging on a support and a close hook portion for holding a things.

BRIEF DESCRIPTION OF THE DRAWINGS

FIGS. 3D and 3E is a partial views on plain in an enlarged scale, showing portions of the disposable hooks are arranged in pairs in FIG. 3C according to the present invention;

DETAILED DESCRIPTION OF THE PREFERRED EMBODIMENTS

Figure 3:
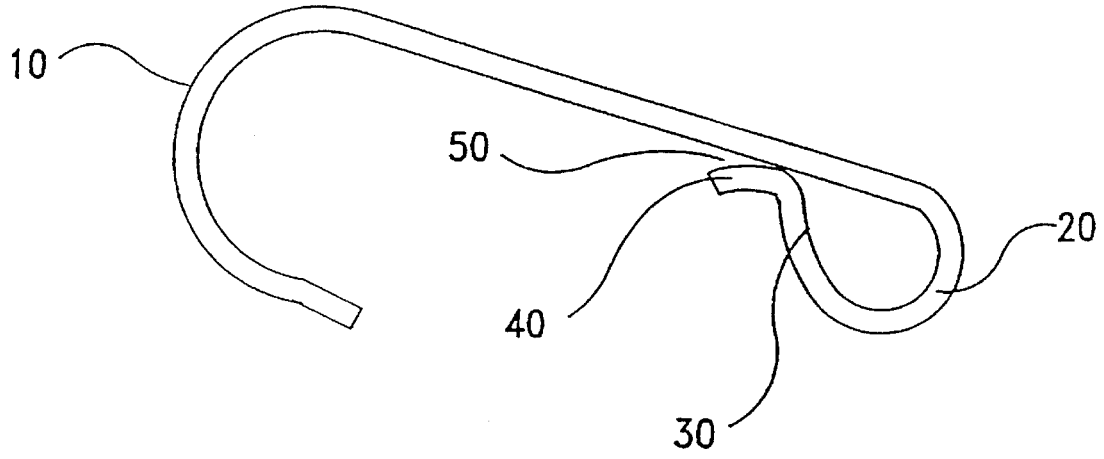
FIG. 3 shows a disposable hook according to the present invention.
Figure 3B:
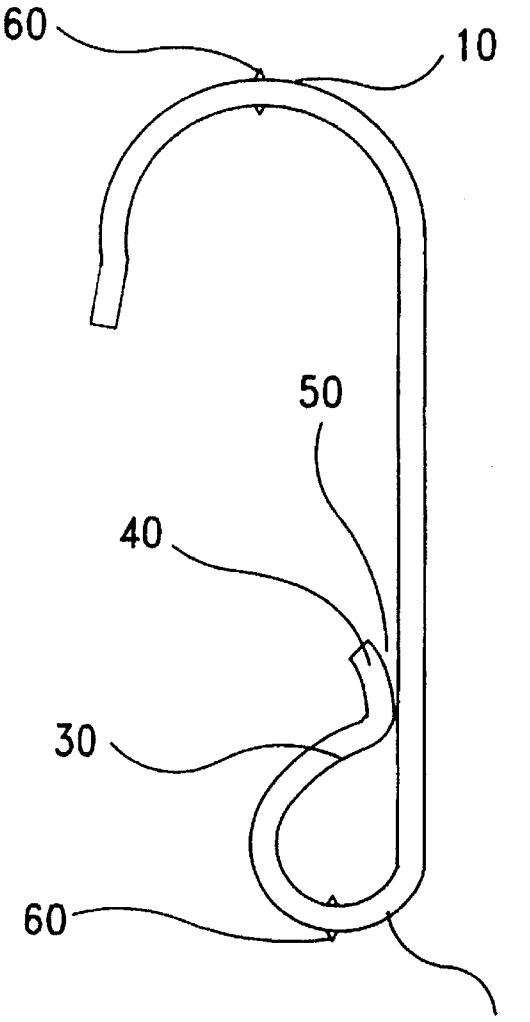
FIG. 3A and 3B shows the structure of the product card and one disposable hook detached from the product card according to the present invention.
Figure 3A:
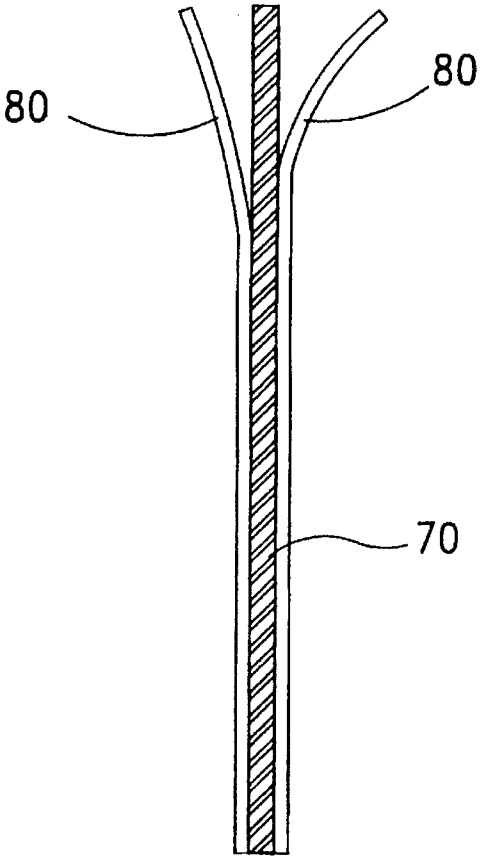

Referring to FIG. 3, a disposable hook in accordance with the present invention has two opposite ends turned inwards and formed into an open hook portion 10 and a close hook portion 20. The close hook portion 20 defines a close loop 30, having a guide tip 40 extended outwards from the body of the disposable hook itself and defining with the disposable hook a mouth 50. Through the mouth 50, the hanging loop of the label or ornament can be forced into the close loop 30 and hung on close hook portion 20.

Figure 1:
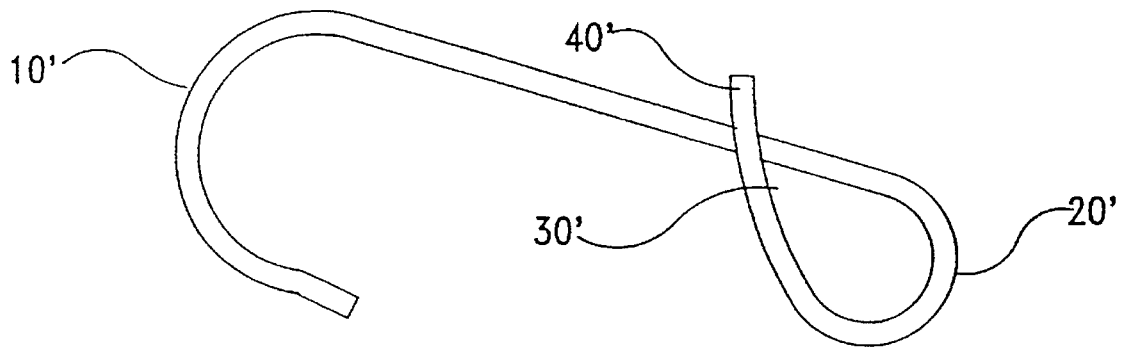
FIG. 1 (PRIOR ART)
FIG. 1 shows a disposable hooks according to the prior art.
Figure 2:
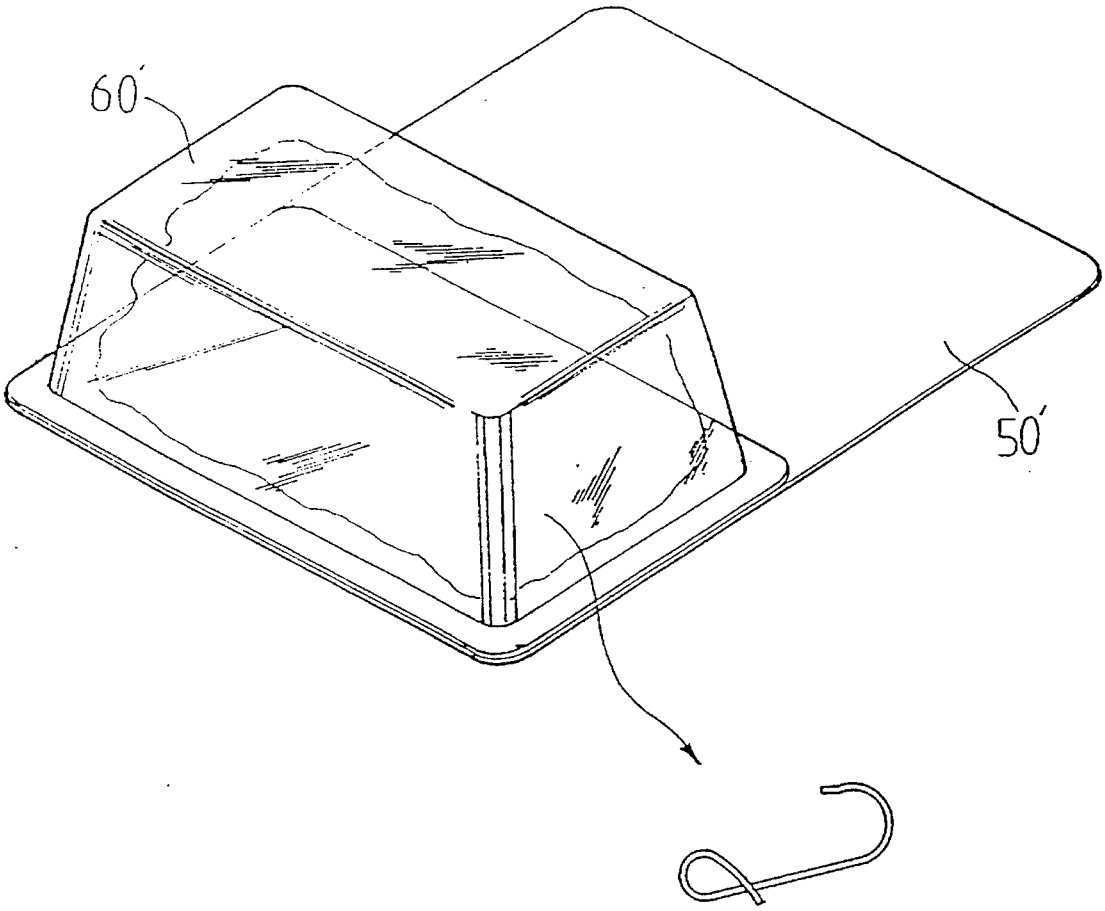
FIG.2 (PRIOR ART)
FIG. 2 shows a blister card for disposable hooks according to the prior art.
Figure 4:
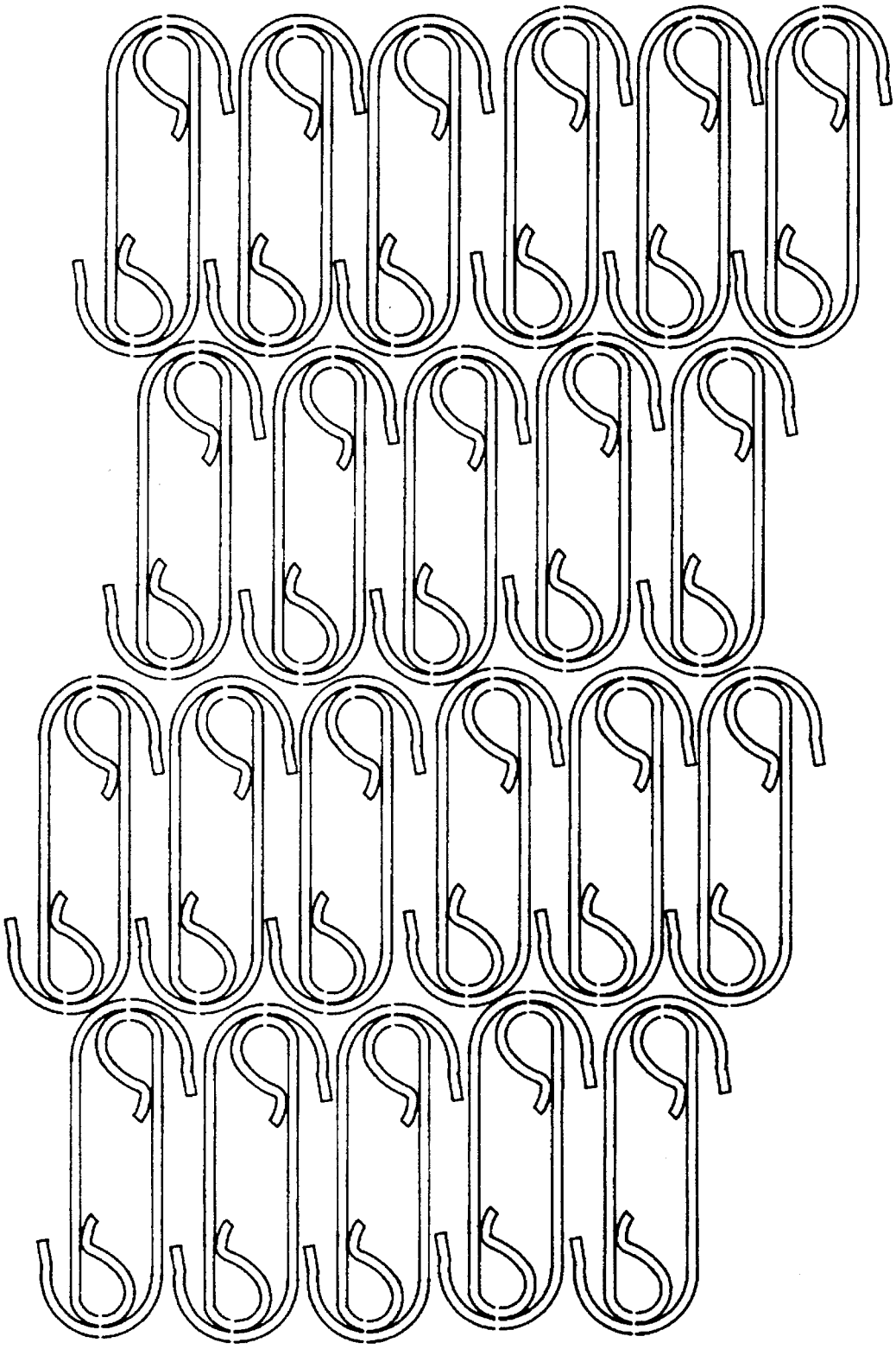
FIG. 4 shows the disposable hooks arranged on the product card according to the present invention.
Figure 5:
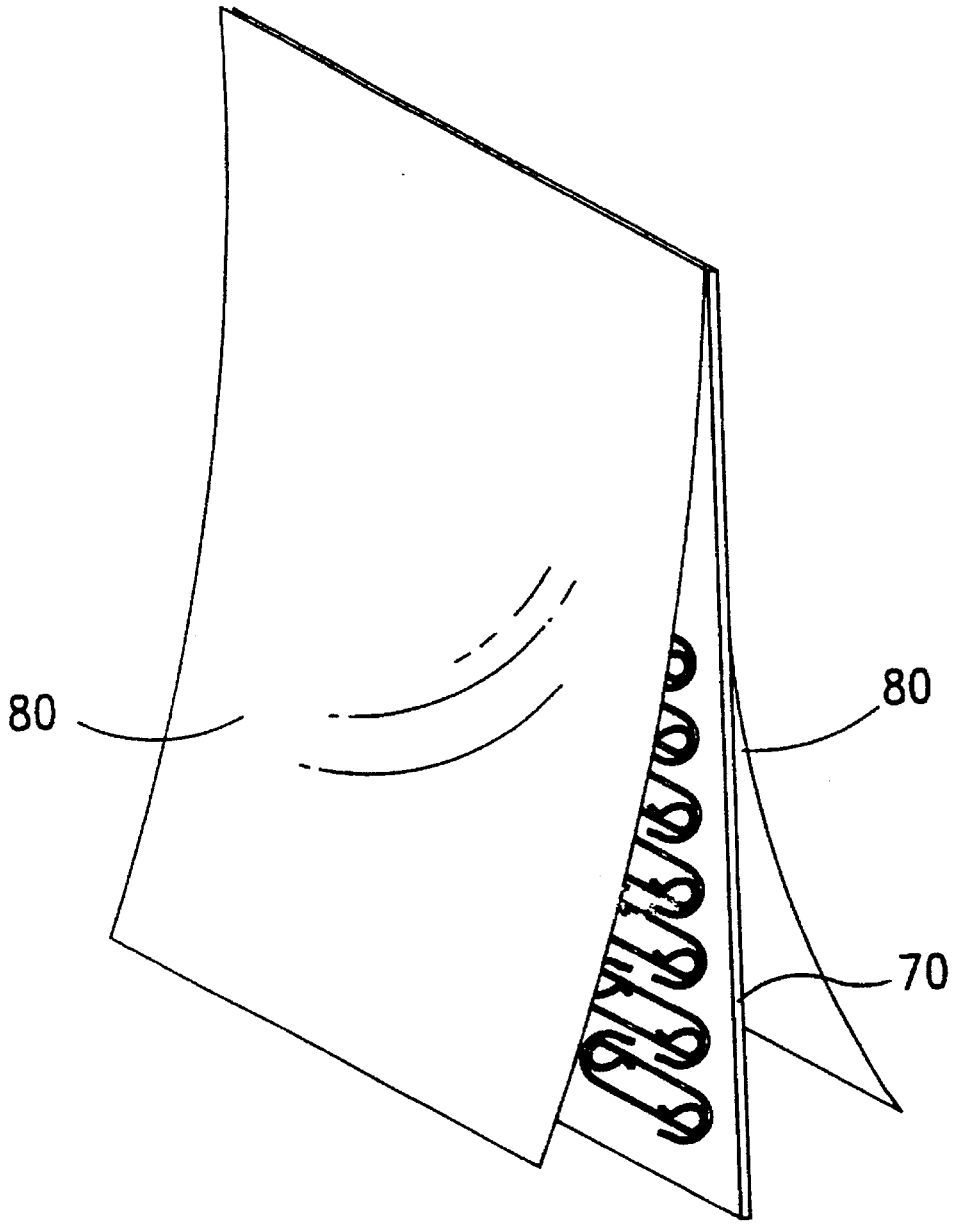
FIG. 5 is an elevational view of the product card showing the strippable cover films detached according to the present invention.

Referring to FIGS. 3A, 3B, 3C, 3D, 3E, 4, and 5, the aforesaid disposable hook is formed in a product card, which is comprised of a sheet of card base 70 and two strippable cover films 80 covered on both sides of the card base 70. The card base 70 is made of paper of 350 lbs of optimum elastic resiliency, and punched to form a plurality of disposable hooks in it. The card base 70 can be printed with any of a variety of patterns, logos, commercial words, etc., before the strippable cover films 80 are covered on the card base 70. The strippable cover films 80 are made of plastics of thickness within 0.1 mm. When disposable hooks are formed in the card base 70 by punching, tiny connecting portions 60 are still linked between the disposable hooks and the card base 70 (see FIGS. 3A and 3B). Therefore, the disposable hooks are maintained in the card base 70 and covered within the strippable cover films 80. As the disposable hooks are arranged in a sheet of product card for sale, they need little storage space. When the strippable cover films 80 are detached from the product card, as shown in FIG. 5, the user can detach the disposable hooks from the card base 70 for use. The connecting portions 60 are of width within 2 mm, therefore they can be easily separated from the card base 70 when the disposable hooks are pulled away from the card base 70. Furthermore, the size of the open hook portion 10 is sufficient for receiving the close hook portion 20, therefore the disposable hooks can be formed in pairs in the card base 70 as shown in FIGS. 3-2 and 4. As illustrated in FIG. 3-2, the close hook portion 20 of one disposable hook is received within and linked to the open hook portion 10 of the other disposable hook of the same pair through the respective connecting portions 60. This arrangement fully utilizes the card base 70, i.e., more pairs of disposable hooks are formed in the card base 70.

Figure 6:
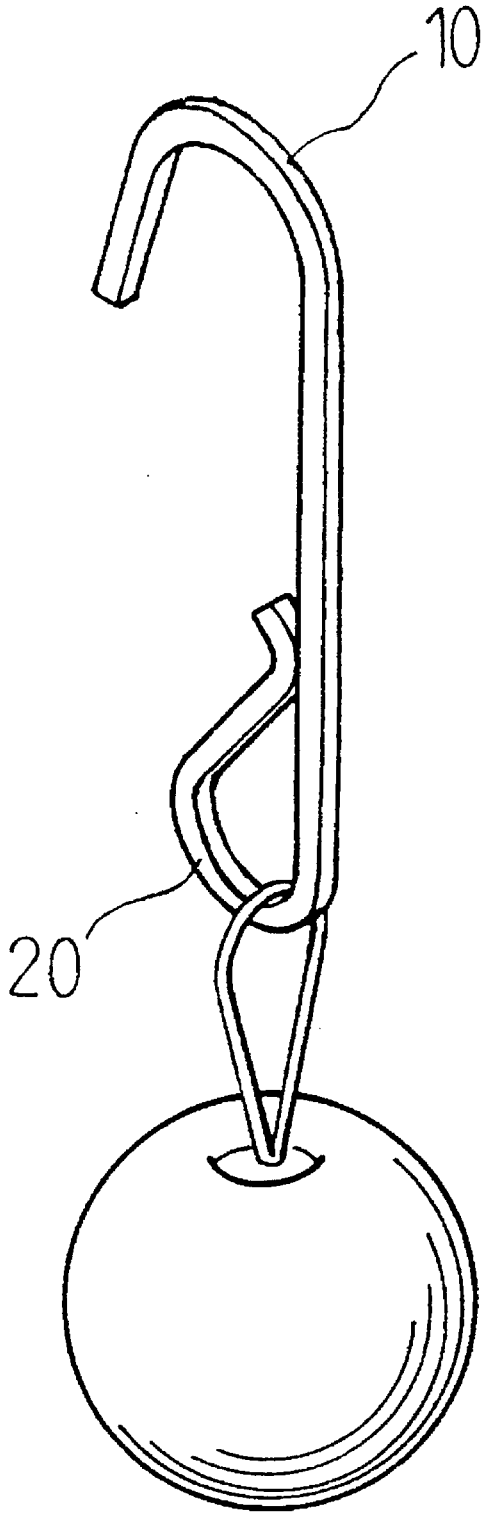
FIG. 6 is an applied view of the present invention, showing an ornament hung on the disposable hook.

FIG. 6 shows an application example of the present invention, in which an ornament is hung on the close hook portion 20, and the open hook portion 10 can be hung on a support.

Figure 7:
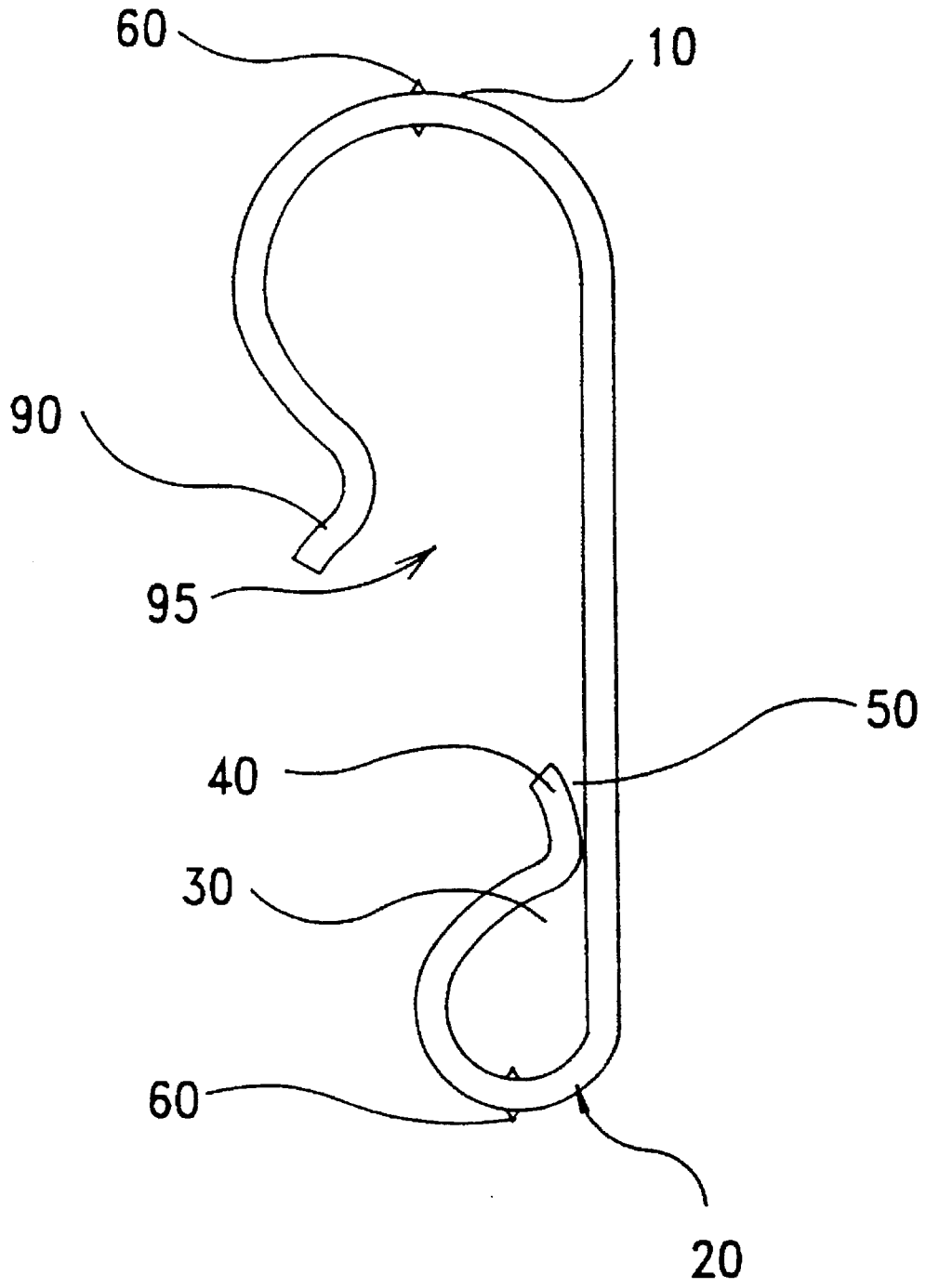
FIG. 7 shows an alternate form of the disposable hook according to the present invention.

FIG. 7 shows an alternate form of the present invention. As illustrated, the end 90 of the open hook portion 10 is curved outwards, defining a broad guide space 95 for guiding the open hook portion 10 into position when to hang the open hook portion 10 on a support.

It is to be understood that the drawings are designed for purposes of illustration only, and are not intended as a definition of the limits and scope of the invention disclosed.

What is claimed is:

1. A product card of hooks comprising a sheet of paper card base having both sides covered with a respective strippable cover film, said sheet of paper card base comprising a plurality of disposable hooks formed in it by punching, each disposable hook comprising an elongated body having two opposite ends turned inwards and formed into an open hook portion and a close hook portion respectively.

2. The product card of claim 1 wherein the size of said open hook portion is bigger than that of said close hook portion so that said close hook portion of one disposable hook can be received within said open hook portion of another.

3. The product card of claim 1 wherein said close hook portion of each disposable hook defines a close loop for hanging things, having a guide tip extended outwards from the body of respective disposable hook defining with the body of respective disposable hook a mouth for guiding the things to be hung into respective close loop.

4. The product card of claim 1 wherein said disposable hooks have at least two connecting portions at two opposite ends respectively linked to said sheet of paper card base, the width of said connecting portions being within 2 mm.

5. The product card of claim 1 wherein said sheet of paper card base has both sides printed with patterns and advertising words and then covered with a respective strippable cover film.

6. The product card of claim 1 wherein said open hook portion of each disposable hook terminates in an outward tip defining with the body of respective disposable hook a broad guide space for guiding said pen hook portion into position when to hang said open hook portion on a support.

* * * * *